United States Patent [19]

Hasegawa et al.

[11] 4,020,302

[45] Apr. 26, 1977

[54] SENSOR HAVING SPRING BIASING STRUCTURE TO RETAIN CONDUCTIVE BRIDGING INERTIAL MASS IN A NON-OPERATIVE POSITION

[75] Inventors: Akira Hasegawa, Katsuta; Takahiko Tanigami, Mito; Kenichi Ushiku, Katsuta, all of Japan

[73] Assignees: Nissan Motor Co., Ltd.; Hitachi, Ltd., both of Tokyo, Japan

[22] Filed: Feb. 19, 1976

[21] Appl. No.: 659,253

[30] Foreign Application Priority Data

Feb. 21, 1975 Japan ..... 50-20923
June 30, 1975 Japan ..... 50-80017

[52] U.S. Cl. ..... 200/61.45 R; 200/61.48; 200/61.51

[51] Int. Cl.[2] ..... H01H 35/14

[58] Field of Search ..... 200/61.45, 61.48–61.53, 200/276, DIG. 45

[56] References Cited

UNITED STATES PATENTS

| | | | |
|---|---|---|---|
| 2,972,026 | 2/1961 | Kendall | 200/61.5 |
| 3,001,039 | 9/1961 | Johnson | 200/61.45 R |
| 3,471,661 | 10/1969 | Miller | 200/61.52 X |
| 3,749,863 | 7/1973 | Kaiser | 200/61.45 R |
| 3,832,507 | 8/1974 | Marquardt et al. | 200/61.51 X |

*Primary Examiner*—James R. Scott
*Attorney, Agent, or Firm*—Beall & Jeffery

[57] ABSTRACT

This invention relates to a sensor suitable for detecting the collision speed of a car or the like. The sensor has a pair of spring members which are supported so as to intersect with each other between free ends and fixed ends thereof, a mass which is supported in the intersecting portion of the spring members, and electric contact members which are arranged at an operative position of the mass. When an intense impulsive force acts, the mass moves onto the operative position side against the springs while shifting the intersecting portion of the springs. In the process of the movement of the mass, the collision speed is detected.

10 Claims, 21 Drawing Figures

SENSOR HAVING SPRING BIASING STRUCTURE TO RETAIN CONDUCTIVE BRIDGING INERTIAL MASS IN A NON-OPERATIVE POSITION

BACKGROUND OF THE INVENTION

This invention relates to a collision speed detecting sensor, and more particularly to a sensor suitable for detecting the collision speed of an automobile.

As a protective apparatus for relieving a shock to which an occupant is subject when an automobile collides, there is an air bag system. The system is equipped with means to detect the magnitude of an impulsive force at the collision.

The magnitude or severity of the shock which the occupant undergoes is concerned, not only with the magnitude of the impulsive force G, but also with the period of time in which the impulsive force G acts. That is, the magnitude of an impact energy which is generally represented by the product between the impulsive force G and the duration thereof is concerned with the magnitude of the shock which the occupant undergoes. From this fact, the magnitude $u$ of the shock can be expressed by:

$$u = \int_0^{\tau} M \cdot G \, dt \qquad \text{Eq. (1)}$$

Here, $t$ denotes the period of time, M the mass of the occupant, G the instantaneous value of the impulsive force, and $\tau$ the duration of G. It is considered from Eq. (1) that the magnitude $u$ of the shock is proportional to the whole change of the car speed from the collision to the stop of the car.

For the above reason, a system which uses a sensor for detecting the whole change of the car speed at the collision of the car has been proposed as improvements in the air bag system. As the sensor of the improved system, there has been known one which employs a spring-mass system. More specifically, the spring-mass system is constructed of a conventional linear spring whose one end is fixed to a base structure and whose other end is a free end, an inertial mass body (hereinafter called "mass") which is attached to the free end of the spring, and an electric contact member. Normally, the mass lies at an inoperative position owing to the preload of the spring. In order that the magnitude of the shock to which the occupant is subjected may be foreknown as early as possible, the sensor is mounted at that part of the car at which the whole change of the speed at the collision of the car appears first, for example, in the vicinity of the front bumper of the car. When the whole change of the car speed is received, the mass moves against the spring force of the spring. When the magnitude of the whole change of the car speed is greater than a predetermined value, the mass is connected with the electric contact member, so that the system is endowed with an electric energy and is actuated. The waveform of the impulsive force G which is an input flowing into the sensor is substantially a half sinusoidal wave, and can be expressed by:

$$G = G_p \sin \omega_o t \qquad (2)$$

Here, $G_p$ denotes the peak value of G, $t$ the period of time, and $\omega_o$ the angular frequency of the input. Letting $\tau$ be the duration of G, $\omega_o = \pi/\tau$. Now, letting $m$ be the mass of the inertial mass body and $k$ be the elastic modulus of the spring, the amount of movement $x$ of the mass becomes:

$$d^2 x/dt^2 = G_p \sin \omega_o t - \omega^2 x \qquad (3)$$

where $\omega^2 = k/m$ $\omega$ denotes the natural angular frequency of the system consisting of the spring and the mass.

When $\omega = \omega_o$ in Eq. (3), $x$ diverges. Accordingly, the natural angular frequency $\omega$ need be made smaller than the angular frequency $\omega_o$ of the input G. In order to make $\omega$ small, the elastic modulus $k$ of the spring is made small or the mass of the inertial mass body is made large. Thus, the amount of movement $x$ of the mass is apparently determined. From experimental results of car collisions, the duration $\tau$ of the input G is below 30 (msec.). Then the optimum value of $\omega$ becomes about 100 (rad/sec.). The maximum amount of movement of the mass at this time becomes about 55 (mm) at a collision speed of 13 mph. Therefore, the sensor is large in size as one of this type and becomes expensive.

SUMMARY OF THE INVENTION

An object of this invention is to eliminate the disadvantages of the prior-art sensor as stated above and to provide a small-sized and inexpensive sensor.

According to the sensor of this invention, a pair of spring members each having one end fixed to a base structure and the other end made free are disposed bilaterally symmetrically so as to intersect in the vicinity of the free ends, and a mass held at the part at which both the spring members intersect can touch and slide in a range from the fixed ends to the free ends of both the spring members, whereby in the case of the movement of the mass, the position of touch between the mass and both the spring members changes, and the elastic modulus of the spring member varies relative to the amount of movement $x$ of the mass. Thus, the spring member substantially becomes a nonlinear spring. In consequence, the foregoing natural angular frequency varies with the movement of the mass.

Accordingly, even if the angular frequency $\omega_o$ of the input G and the natural angular frequency $\omega$ of the system are equal at a certain position of the mass, $\omega = \omega_o$ will be established due to a slight movement of the mass, and hence, the amount of movement $x$ of the mass will not diverge. Since no restriction is therefore made by the value of $\omega_o$, the spring can be rendered small in size and accordingly the sensor can be rendered small-sized and inexpensive.

BRIEF DESCRIPTION OF THE DRAWING

FIG. 10 is a top sectional view of another embodiment of this invention, while

FIG. 17 is a side view showing a part of a mass for snugly fitting elastic members in a still further embodiment of the detector for the collision speed of a car according to this invention, while

PREFERRED EMBODIMENTS OF THE INVENTION

Figure 1:
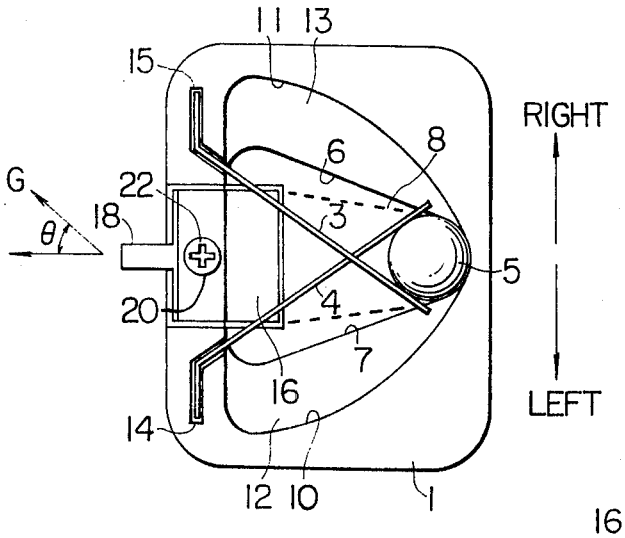
FIG. 1 is a top sectional view showing an embodiment of this invention.
Figure 2:
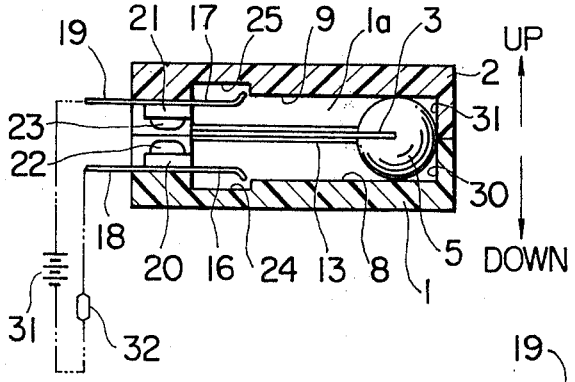
FIG. 2 is a side sectional view corresponding to FIG. 1.
Figure 7:
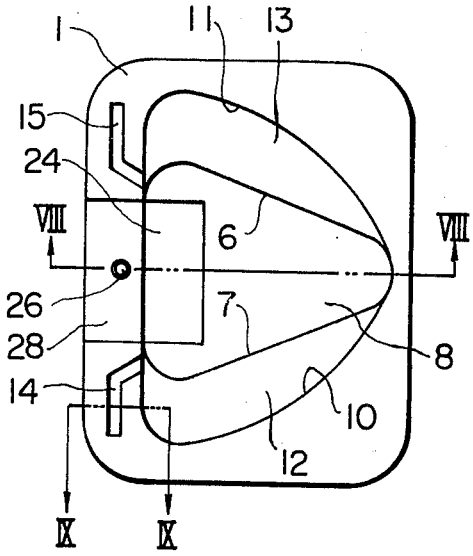
FIG. 7 is a plan view of a base structure.
Figure 8:
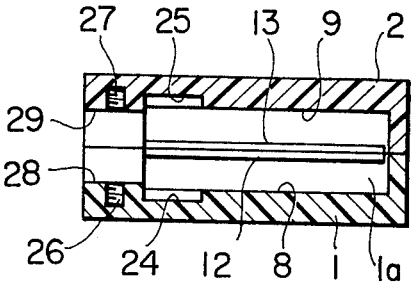
FIG. 8 is a sectional view taken along VIII—VIII in FIG. 7.
Figure 9:
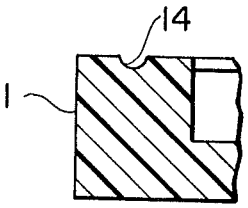
FIG. 9 is a sectional view taken along IX—IX in FIG. 7.

Hereunder, this invention will be described in conjunction with embodiments illustrated in the drawing. Referring to FIGS. 1 and 2, numerals 1 and 2 designate bases. The base 1 and the base 2 have the same configurations, and they are symmetric with respect to a center line VIII—VIII on a plane as shown in FIG. 7. As shown in FIG. 2, the bases 1 and 2 are placed on each other to define a space portion 1*a* therebetween. They are joined in such a way that joint portions are subjected to the ultrasonic joining, or that holes are provided at suitable plane positions (not shown) and that bolts etc. are used for clamping. Shown at 3 is a bar as a leaf spring member, which is made of spring steel. One end of the bar 3 is fitted and retained in a spring retaining groove 15 provided in the bases 1 and 2. Likewise, one end of a bar 4 is fitted and retained in a spring retaining groove 14 symmetrically to the bar 3, the groove 14 being provided in the bases 1 and 2. The free parts of the bars 3 and 4 intersect so as to form the X-shape on a plane. A mass (inertial mass body) 5 is held between the bars 3 and 4 on the free end side with respect to the point of the intersection, and it lies in contact with the bars 3 and 4. Normally, the mass 5 is pushed against mass stopper walls 30 and 31, provided in the bases 1 and 2, by spring forces of the bars 3 and 4 and it is in an inoperative state. By a lower mass receiving surface 8 and an upper mass receiving surface 9 respectively provided in the bases 1 and 2, the mass 5 is checked from moving in the vertical direction indicated in FIG. 2. On the side opposite to the mass stopper wall 30, an electric contact member 16 is mounted by a washer 20 and a screw 22. That part 18 of the electric contact member 16 which extends outside is a terminal 18. That part of the member 16 which extends inside has the front end curved slightly and directed towards a recess 24. Likewise, on the side opposite to the mass stopper wall 31, an electric contact member 17, which includes a terminal 19 extending outside and whose part extending inside has the front end curved slightly and directed towards a recess 25, is mounted by a washer 21 and a screw 23. Shown at 6 is a mass guide wall. It is provided in the bases 1 and 2 along the position of the bar 3 at the time when the mass 5 lies at the inoperative position and in a manner to be spaced from the bar 3 by a distance smaller than the external size of the mass 5. Likewise, a mass guide 7 is provided in the bases 1 and 2 along the bar 4 and at a distance smaller than the external size of the mass 5. Numerals 12 and 13 designate spring receiving portions which receive the free ends of the respective bars 3 and 4. Referring now to FIGS. 7, 8 and 9, the bases 1 and 2 will be explained. The spring receiving portions 12 and 13 define thin spaces above and below the joint surfaces of the bases 1 and 2. Within the spaces, the free ends of the bars 3 and 4 can move on a plane in a manner to be checked in the vertical direction. Numerals 10 and 11 indicate spring guide walls of circular arcs somewhat greater than circular arcs which the bars 3 and 4 depict about the fixed parts thereof. The spring guide walls 10 and 11 serve to secure the spaces of the spring receiving portions 12 and 13 from the joint surfaces of the bases 1 and 2. Numerals 26 and 27 represent tapped holes for mounting the electric contact members 16 17, while numerals 28 and 29 represent contact member-mounting surfaces. As shown in FIG. 9, the spring retaining groove 14 (the same applies to the groove 15) for retaining the bars 3 and 4 has a semicircular sectional shape depressed from the joint plane of the bases 1 and 2. When the bases 1 and 2 are joined, the grooves form a circular section.

Figure 3:
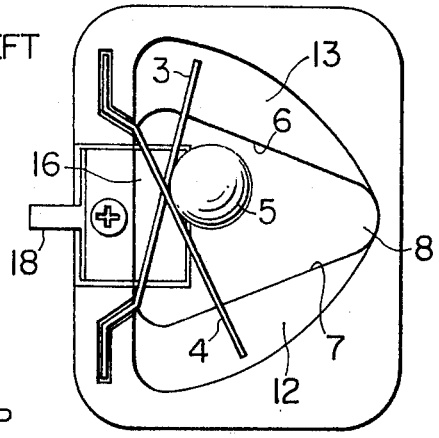
FIG. 3 is a plan view showing an operative state of the embodiment of this invention.
Figure 4:
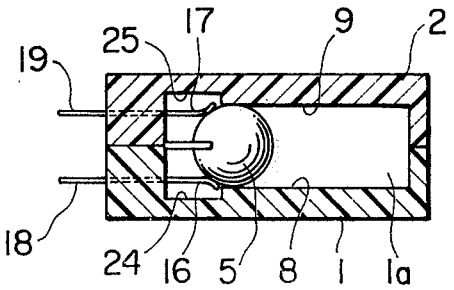
FIG. 4 is a side sectional view corresponding to FIG. 3, FIGS. 5*a*, 5*b* and 6 are operating curve diagrams.

The operation of the sensor according to this invention will not be explained. When an input G is received in the direction of arrows in FIG. 1, the mass 5 moves in the direction of arrows against the spring forces of the bars 3 and 4. When an input in which the whole change of a car speed exceeds a predetermined value is given, the mass 5 moves until it comes into contact with the electric contact members 16 and 17. The mass 5 is made of a conducting material, and is plated with a noble metal such as gold in order to fully demonstrate the contact function. The electric contact members 16 and 17 use a spring material, for example, beryllium copper plate, and the surfaces are subjected to a noble metal plating. The distance of opposition between the electric contact members 16 and 17 is made smaller than the external size of the mass 5. Therefore, when the mass 5 moves till its contact with the electric contact members 16 and 17, the members 16 and 17 are displaced owing to the spring characteristics thereof into the recesses 24 and 25 provided in the bases 1 and 2, and the mass 5 enters in between them, so that a good contact is established. Thus, a series circuit consisting of a power source 31 and an actuator 32 of an air bag system as connected to the terminals 18 and 19 is formed to actuate the system. When the input G is exerted in a direction having a declination Θ rightwards or leftwards with respect to the front of a car, the mass 5 moves to draw nearer to the declination Θ side or rightwards in FIG. 1. An example in this case is illustrated in FIGS. 3 and 4.

When the declination Θ is zero, the movement of the mass 5 occurs substantially frontwards. At this time, the contact position between the bars 3, 4 and the mass 5 is spaced equally from the respective retained positions of the bars 3 and 4. If the input flows in the direction of a nonzero declination ", the mass 5 moves obliquely frontwards nearer to the declination side. As shown in FIG. 3, therefore, the contact position between the mass 5 and the bar 3 and that between the mass 5 and the bar 4 are different. The spring forces of the bars 3 and 4 become intenser as the distances of the points of application are shorter. Consequently, when the spring force of the bar 3 is feeble, that of the bar 4 becomes intense, so that the sum of the spring forces acting on the mass 5 can be made substantially uniform for the movement of the mass 5 ascribable to the input of the declination Θ.

Figure 5A:
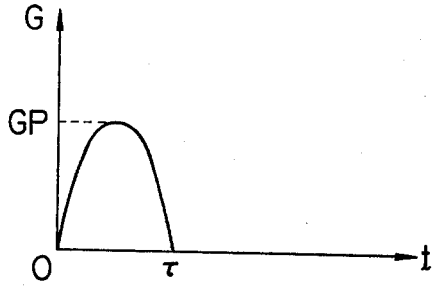
Figure 5B:
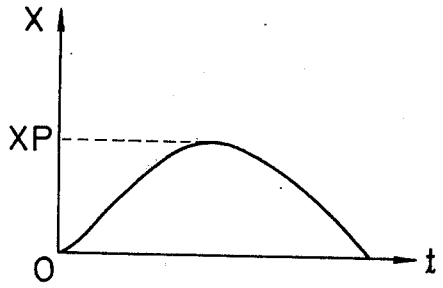

FIG. 5(*a*) depicts the waveform of an input G. When such input G flows into the sensor, the amount of movement X of the mass 5 becomes as shown by a waveform in FIG. 5(*b*). The collision speed V can be expressed by:

$$V = \int_{o}^{\tau} G_p \sin \frac{\pi}{\tau} t \, dt = \frac{2_\tau G_p}{\pi} \qquad \text{Eq. (4)}$$

Figure 6:
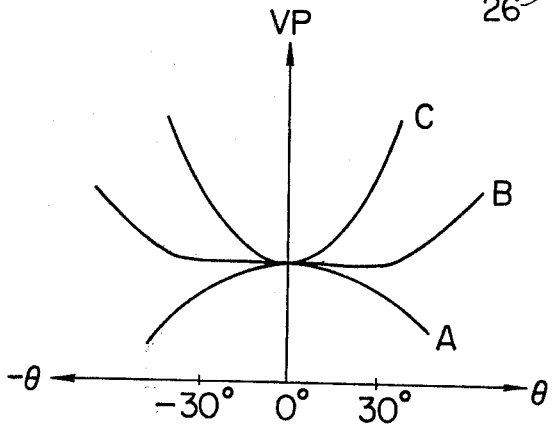

Let $V_p$ denote the whole change input of the car speed for the limit at which the mass 5 barely comes into contact with the electric contact members 16 and 17 due to its movement (hereunder termed the actuation limit speed). Then, the characteristic of the sensor at the time when an input G rendering $V_p=(2/\pi)Gp \times \tau$ is given is required to be put into a curve B in FIG. 6. More specifically, it is required that $V_p$ is substantially constant for a range of Θ from −30° to +30°, while $V_p$ is large for a range of Θ<−30° or Θ>+30°. If the mass guide walls 6 and 7 are not provided, the mass 5 will move in contact with only one of the bars 3 and 4 for values in the Θ-direction of the input G, and hence, the sum of the spring forces acting on the mass 5 will become small, so that the mass 5 will become easy to move. At this time, the mass 5 will move with a large rightward or leftward deviation. Therefore, if the electric contact members 16 and 17 are placed on circular arcs at a distance $X_p$ from the inoperative position of the mass 5, the actuation limit speed $V_p$ will become small versus the declination Θ as indicated by a curve A in FIG. 6. If the mass guide walls 6 and 7 are made as shown by broken lines in FIG. 1, the $V_p - \Theta$ characteristic will become as shown by a curve C in FIG. 6 with $V_p$ being large versus Θ. By setting the mass guides 6 and 7 at the appropriate positions as previously stated and as indicated by solid lines in FIGS. 1, 3 and 7 can be made as shown by the curve B in FIG. 6.

The sensor of this invention as set forth above brings forth technical results as described below.

While the mass 5 and the springs 3 and 4 are kept in contact, the points of contact vary with the movement of the mass 5, so that the springs can be made substantially nonlinear springs. Thus, the springs can be miniaturized, and a small-sized and inexpensive sensor can be provided.

The spring means employs the two bars 3 and 4 which intersect substantially into the X-shape and the mass guide walls are provided, so that a collision speed can be effectively detected even for an oblique collision of the car.

Further, the electric contact assembly is composed of the two members 16 and 17, the electric contact members 16 and 17 are opposed in a manner to be spaced by a distance smaller than the external size of the mass 5 and the mass 5 is adapted to fit between the opposed members, so that a reliable contact can be acquired by the simple electric contact means.

Figure 10:
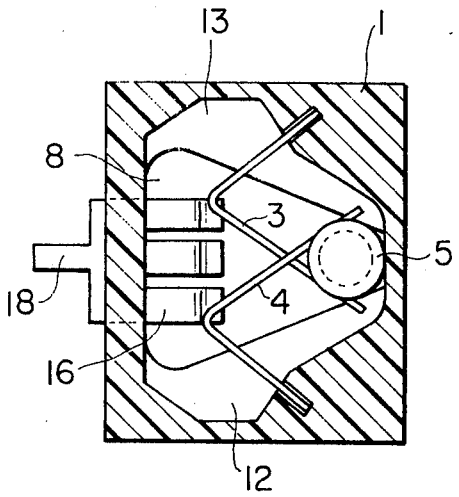
Figure 11:
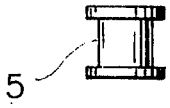
FIG. 11 is a detailed view of a mass in FIG. 10.

FIG. 10 shows another embodiment of this invention. V-shaped leaf spring bars 3 and 4 are fixed to bases 1 and 2 in a manner to intersect in the vicinity of the free ends thereof. A mass 5 is held between the bars on the free end side of the intersecting parts. As shown in FIG. 11, the mass 5 is bobbin-like. Numeral 16 designates an electric contact member similar to that in the foregoing embodiment. Also in the present embodiment, contact portions of the mass 5 with the bars 3 and 4 change with the displacement of the mass 5, so that the bars 3 and 4 exhibit nonlinear characteristics.

Figure 12:
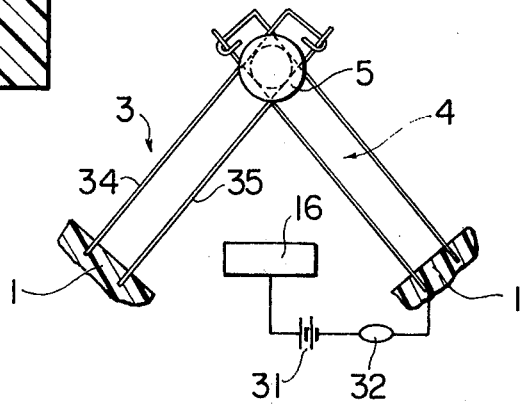
FIG. 12 shows still another embodiment of this invention.
Figure 13:
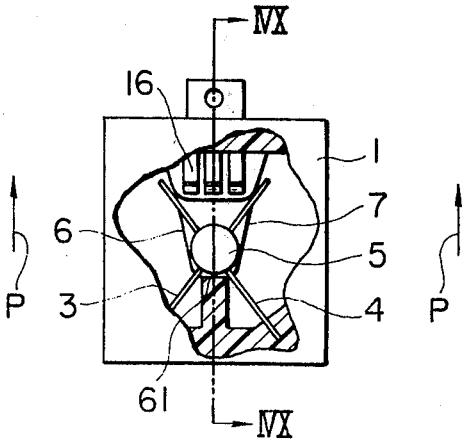
FIG. 13 is a sectional view showing a further embodiment of the sensor for detecting the collision speed of a car according to this invention.
Figure 14:
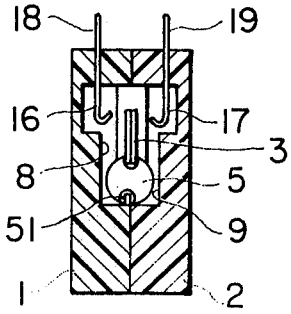
FIG. 14 is a sectional view taken along line XIV—XIV in FIG. 13.
Figure 15:
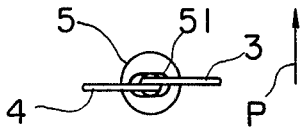
FIG. 15 is a side view showing a part of a mass for mounting spring means in the embodiment.
Figure 16:
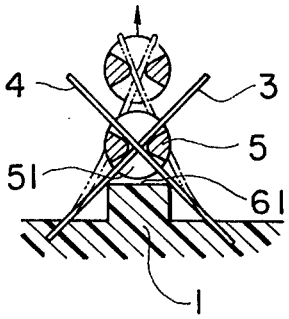
FIG. 16 is a sectional view showing the mounting part.

In an embodiment illustrated in FIG. 12, each of left and right spring members 3 and 4 are constructed in such a way that one 34 of bars 34 and 35 each having one end fixed to a base 1, 2 has its fore end bent and engaged with a fore end part of the other bar 35. A mass 5 is held at the point of intersection between the spring members 3 and 4. Also in this case, the spring members 3 and 4 exhibit nonlinear characteristics with the displacement of the mass 5. As regards the electrical connection, the spring itself can be made a part of a circuit.

According to this embodiment, it is also possible to omit right and left mass guide walls.

In another embodiment shown in FIGS. 13 – 16, a mass 5 is provided with a penetrating hole 51, in which spring bars 3 and 4 are inserted. The mass is held by the springs 3 and 4 so as to engage a stopper 61 when the sensor does not operate.

In this collision speed detector, the mass 5 is made spherical. Therefore, even when the mass 5 is distorted by reactions of the springs 3 and 4 in operation, it does not become hard to enter between contact members 16 and 17. The contact closure time can be made long, and a good contact closure time characteristic can be attained. In addition, the mass can smoothly move on guide walls 6 and 7.

Damped oscillations which arise at the return of the springs 3 and 4 are preventable.

Figure 17:
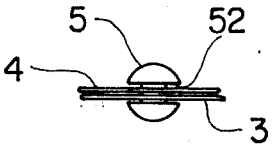
Figure 18:
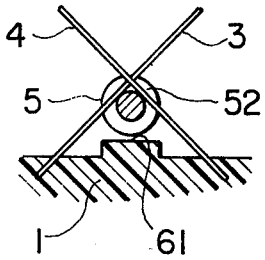
FIG. 18 is a sectional view showing the snugly fitting part.

FIGS. 17 and 18 show another embodiment of the collision speed detector according to this invention. The circumferential surface of a spherical mass 5 is formed with a ring-shaped groove 52. The mass 5 has the groove 52 fitted on the rear side in the car advancing direction, of the intersecting part between the spring bars 3 and 4. The remaining construction is the same as in the preceding embodiment.

Also in this embodiment, the mass 5 is made spherical. Therefore, even when the mass is distorted by reactions of the spring bars 3 and 4 in operation, it does not become difficult to enter between the contact members 16 and 17. Such inconvenience that the mass 5 is caught between the guide walls 6 and 7 does not occur, either.

Figure 19:
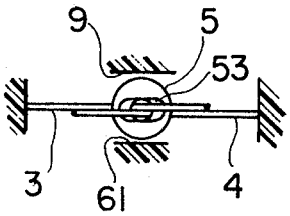
FIGS. 19 and 20 are a front view and a sectional view showing a yet further embodiment, respectively.
Figure 20:
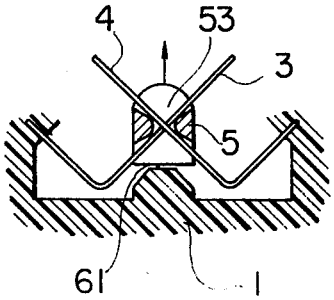

FIGS. 19 and 20 illustrate a further embodiment of this invention. A mass 5 disposed at the intersecting part between a pair of springs 3 and 4 is substantially cylindrical and is formed with a penetrating hole 53. In addition, the mass 5 is circular in a section in a direction orthogonal to its operating direction (the direction of arrow in FIG. 20). Accordingly, even when the mass 5 is distorted by reactions of the springs 3 and 4, there does not occur the inconvenience that the mass is caught by the guide walls 6 and 7 or that it is hard to enter between the contact members 16 and 17. When the length of the mass 5 in the operating direction is too short, an inferior operation arises for another reason. It is therefore desirable that the length is approximately equal to or greater than the diameter of the orthogonal section.

Also in case where the contact members 16 and 17 are constructed of a single contact material, not of the paired members, this invention is applicable.

As set forth above, when the shape of the mass is made spherical, there is achieved the excellent technical result that the contact closure time can be made long and that a good contact time characteristic can be attained.

The spring member can adopt a plate-shaped one or one of any other shape besides the bar-shaped one.

While a preferred embodiment of the present invention has been described specifically in detail for purposes of illustration and the advantages of the details, with modifications and variations, further embodiments, modifications and variations are contemplated according to the broader aspects of the present invention, all as determined by the spirit and scope of the following claims.

We claim:

1. In a collision speed detecting sensor having a base structure which is formed with a predetermined space portion, at least one electric contact member which is arranged at one end of the space portion, a spring member which is situated within the space portion and whose one end is supported by the base structure, and a mass which lies within the space portion, which is normally restrained at an inoperative position by the spring member and which, when subjected to an impulsive force greater than a predetermined value, moves to an operative position against the spring member and touches the electric contact member, the improvement comprising a pair of spring means symmetric in shape to constitute said spring member, means to fix one end of each said spring means onto said base structure in such a manner that both said spring means intersect with each other between free ends and fixed parts thereof, and means to hold said mass in engagement with both said spring means in the vicinity of the intersecting portion of both said spring means while said intersecting portion moves with said mass toward said at least one electric contact member when subjected to the impulsive force greater than the predetermined value.

2. The collision speed detecting sensor according to claim 1, wherein said base structure is so constructed that a line extending between said inoperative position and said operative position of said mass lies within a horizontal plane, wherein said means to hold includes upper and lower mass receiving surfaces of said base structure which limit a movement of said mass in a vertical direction and guide walls of said base structure which limit a movement of said mass in a direction orthogonal to said direction coupling said inoperative position and said operative position of said mass within said horizontal plane, and wherein said walls define said space portion.

3. The collision speed detecting sensor according to claim 2, wherein said base structure includes spring receiving space portions which expand outside of said mass guide walls and which receive said free ends of said spring means as displaced by the moving mass within a horizontal plane.

4. The collision speed detecting sensor according to claim 2, wherein said mass guide walls are disposed along positions of the respective spring means at the time when said mass is situated at said inoperative position and in a manner to be spaced from said spring means by a distance smaller than the external size of said mass between respective said spring means and guide walls.

5. The collision speed detecting sensor according to claim 2, wherein each said spring means is constructed of a bar of spring steel.

6. The collision speed detecting sensor according to claim 2, wherein said mass is spherical and has a penetrating hole into which said pair of spring means are inserted in an intersecting manner.

7. The collision speed detecting sensor according to claim 6, wherein a section of said mass in a direction orthogonal to the moving direction of said mass is substantially circular.

8. The collision speed detecting sensor according to claim 1, wherein each of said spring means includes a leaf spring cantilevered from one end fixed to said base structure to a free end, said spring means of said pair are symmetrical with respect to a central vertical plane normally bisecting said mass in its inoperative position and including said intersection of said spring means; said spring means biasing said mass towards said inoperative position from said operative position, and resiliently bending as said mass moves from said inoperative position towards said operative position and as said intersection moves towards said operative position.

9. The collision speed detecting sensor according to claim 8, wherein said means to hold said mass and said base structure permit movement of said mass away from said inoperative position along a line of travel defining an angle with respect to said vertical plane within a substantial range of angles on either side of said vertical plane according to the direction of collision while at the same time maintaining contact between said mass and each of said spring means and providing engagement with said at least one electric contact member in the corresponding operative position.

10. The collision speed detecting sensor according to claim 9, wherein said range of angles includes approximately 30° to each side of said vertical plane and the collision deceleration required to move said mass from said inoperative position to said operative position remains substantially constant throughout said range of angles.

* * * * *